United States Patent [19]

Bolander

[11] Patent Number: 4,915,043

[45] Date of Patent: Apr. 10, 1990

[54] DEVICE FOR FOLDING AN EDGE OF A FABRIC FOR MAKING A HEM

[75] Inventor: Lars Bolander, Borås, Sweden

[73] Assignee: Akab of Sweden AB, Sweden

[21] Appl. No.: 255,155

[22] Filed: Oct. 7, 1988

[30] Foreign Application Priority Data

Oct. 9, 1987 [SE] Sweden ..... 8703900

[51] Int. Cl.[4] ..... D05B 35/02

[52] U.S. Cl. ..... 112/147; 112/304

[58] Field of Search ..... 112/304, 147, 141, 153, 112/152, 143; 493/423, 441

[56] References Cited

U.S. PATENT DOCUMENTS

| | | | |
|---|---|---|---|
| 4,464,160 | 8/1984 | Joyce | 112/147 |
| 4,506,613 | 3/1985 | Ragnebring | 112/143 |
| 4,648,336 | 3/1987 | Ragnebring | 112/147 |

FOREIGN PATENT DOCUMENTS

| | | | |
|---|---|---|---|
| 0158614 | 3/1985 | European Pat. Off. | 112/147 |
| 127120 | 5/1919 | United Kingdom . | |

*Primary Examiner*—Andrew M. Falik

*Attorney, Agent, or Firm*—Ostrolenk, Faber, Gerb & Soffen

[57] ABSTRACT

A device for folding an edge of a fabric for making a single or a double hem. The device includes a pair of cooperating endless, driven bands for conveying the fabric edge through the device. One of the bands cooperates with a fixed rule and is twisted to correspond to the gradual folding of the fabric edge. The speed of one of the bands can be temporarily varied relative to the other so that the trailing edge of the hem is located somewhat inside of an edge of the fabric which extends transversely to the hem.

9 Claims, 3 Drawing Sheets

11
12
13
14
15
16
17
18
19
20
21
22
23
24
25
26
27
28
30
31
32
33
34
35
38
39
40
41
42
43
44
45

DEVICE FOR FOLDING AN EDGE OF A FABRIC FOR MAKING A HEM

BACKGROUND OF THE INVENTION

1. Field of the Invention

The invention relates to a device for folding an edge of a fabric to form a single or double hem.

2. Description of the Related Art

Hem shaping devices are known. The most common such device consists of a helical, conical sleeve through which a fabric edge is passed as folding takes place. Another hem shaping device consists of two fixed folding bars with upwardly directed portions between which folding takes place. However, the spacing between the bars cannot be instantaneously changed to let a relatively thick transverse seam pass through. This ia an obvious drawback.

No. EP-A-0 158 614 illustrates another device for shaping a hem. The device includes an endless, driven band. The band is twisted along a rule to gradually fold the fabric during transport thereof through the device. The device is insensitive to variations in the thickness of the fabric. Thick transverse seams can pass through the device without difficulty.

When hemming towels or sheets, the end edges of the transverse hems should not be located outside the longitudinal fabric edge. Rather, the end edges should be drawn somewhat inside the longitudinal fabric edge. This does not present a problem at the feed end of the hem, but at the feeding-out end of the hem there is a tendency for the trailing end to be drawn slightly outside the fabric edge.

SUMMARY OF THE INVENTION

The invention represents an improvement over the devices illustrated in No. EP-A-0 158 614.

An object of the invention is to provide a simple improved folding device which forms a hem with the edge of the hem located level with or just inside the fabric edge extending across the hem. This object is achieved when a band within a hem-forming device with two bands cooperates with means for temporarily varying the relative speeds of the bands.

Other features and objects of the invention will become apparent from the following detailed description of the preferred embodiments of the invention considered in conjunction with the accompanying drawings.

DETAILED DESCRIPTION OF THE PREFERRED EMBODIMENTS

Figure 1:
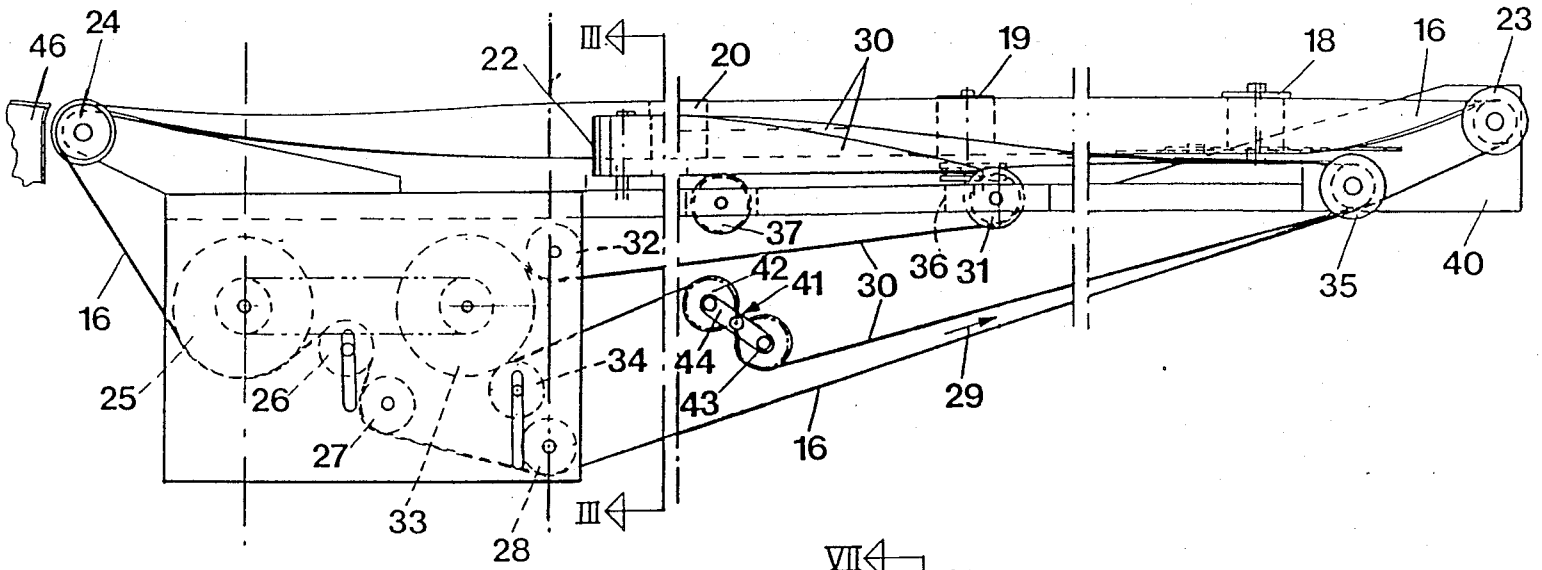
FIG. 1 is a side view of a device in accordance with a preferred embodiment of the invention.

The preferred embodiments of the invention correspond largely to the devices disclosed in No. EP-A-0 158 614, which include a feed table 11 (FIG. 3) with a top 12. Fabric 13 to be folded is transported along the table top 12 by an endless band 14. The band 14 feeds the fabric 13 in the longitudinal direction of the table 11. At one side of the table 11, a vertical rail forms a first folding rule 15. A first endless transport band 16 is arranged outside of the rule 15.

A first shaping section 17 (FIG. 2) is arranged along the rule 15. The band 16 is essentially vertical and substantially parallel to and in contact with the rule 15 within the first shaping section 17. Guide rolls 18–21 and pulley rolls 23, 24 keep the band 16 in position within the section 17. The endless band 16 extends around the pulley rolls 23, 24, a drive roll 25, a stretching roll 26, and pulley rolls 27 and 28, and is driven in the direction of the arrow 29.

A second endless band 30 is opposite the rule 15 and cooperates with the band 16. The band 30 is substantially horizontal at the beginning of the section 17 and is gradually twisted such that it is vertical at a pulley roll 22. The band 30 extends from the pulley roll 22 to pulley 31 and 32, to a drive roll 33, around a stretching roll 34 to a pulley roll 35, and then back to the pulley roll 22. The band 30 is supported and guided by support rolls 36 and 37 (FIG. 1).

The band 16 (FIG. 2) is twisted from a vertical position at a press nip formed between the rolls 21 and 22 to a horizontal position at the pulley roll 24 along a second shaping section 38. The band 16 contacts a second rule 39 within the section 38. The rule 39 is also twisted correspondingly with the band 16. The rule 39, like the rule 15, is fixed to the table top 12. All the rolls for supporting and driving the two endless bands 16 and 30 are mounted in a frame 40 (FIG. 1).

Figures 2, 3, 4:
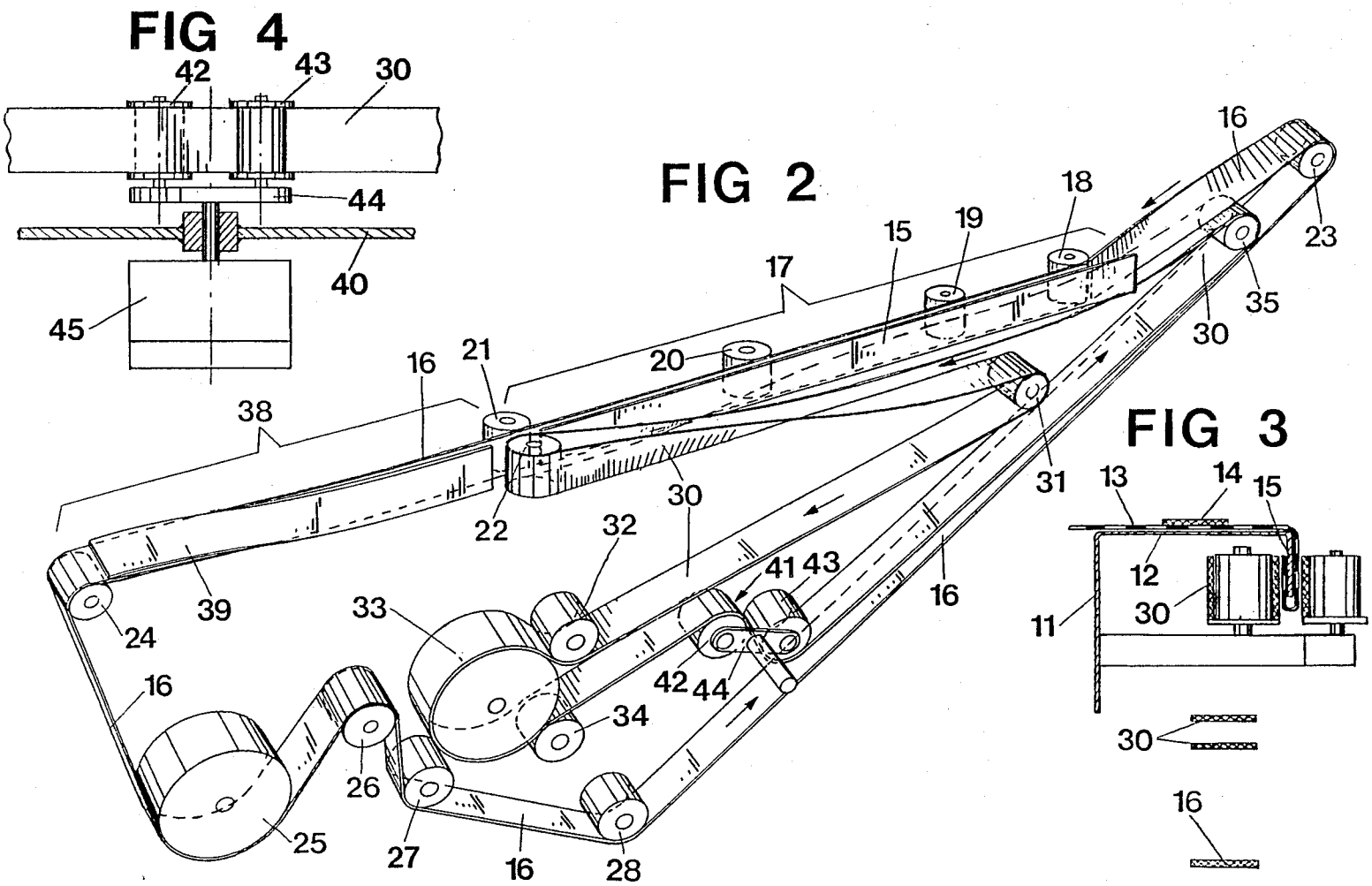
FIG. 2 is a perspective view of the device of FIG. 1.
FIG. 3 is a cross-sectional view through the line III—III of FIG. 1.
FIG. 4 is an enlarged cross-sectional view of a band stretching device for use in the device of FIG. 1.

A band stretching device 41 cooperates with the band 30 shortly after the band 30 passes the stretching roll 34. The band stretching device 41 consists of two rolls 42 and 43 mounted in a plate 44. The plate 44 is rotatably mounted on the frame 40. The plate 44 is rotated by an actuator 45 (FIG. 4). The band 30 (FIG. 2) is stretched or slackened according to the rotation of the plate 44. When the band 30 is stretched, its speed increases. Correspondingly, the speed of the band 30 is reduced when it is slackened.

The device operates as follows: The bands 16 and 30 are driven by a common motor (not illustrated) in the direction of the arrow 29. Thus, in the shaping sections 17 and 38, the bands 16 and 30 travel in the same direction as the transport band 14 (FIG. 3). The fabric 13 is clamped between the band 14 and the table top 12 and is displaced by the band 14 along the entire folding device. The fabric 13 is guided into the folding device so that the fabric's 13 edge **13*a* hangs over the side of the table top 12. The overhanging fabric edge 13*a* is guided in between the rule 15 and the band 16. Thus, a projecting end portion of the fabric edge 13*a* will come into contact with the band 30, which is substantially horizontal at the point where the fabric edge 13*a*** enters the device.

As the fabric edge **13*a* travels through the folding device, the projecting end portion will be folded up more and more against the inside of the rule 15 by the band 30 as the band 30 is twisted from a horizontal position to a vertical position. The vertical band 16 helps to transport the fabric edge 13*a* along the outer side of the rule 15**.

At the section III—III of FIG. 1, the fabric edge 13a has been folded into a U about the rule 15 and the two shanks of the U are fixed by the bands 16 and 30. The fabric edge 13a will then separate from the band 30 as the leading end of the fabric edge 13a is brought into contact with the rule 39. In cooperation with the band 16, the fabric edge 13a is gradually folded in the second shaping section 38 toward the table top 12, so that when it leaves the pulley roll 24 a double folded hem has been formed.

By temporarily increasing the speed of the band 30 relative to the band 16 as the trailing end of the fabric 13 is fed through the folding device, the edge of the trailing end of the hem formed by the device is drawn slightly forward with respect to the rest of the fabric 13 such that the edge of the trailing end of the hem is located slightly inside of an edge of the fabric 13 extending transversely to the hem.

A sewing machine 46 (FIG. 1) for sewing the hem is in position to cooperate with the pulley roll 24.

The guide rolls 18, 19, 20, and 21 are spring-loaded and can spring aside so that relatively thick transverse seams can pass therethrough.

Figure 5:
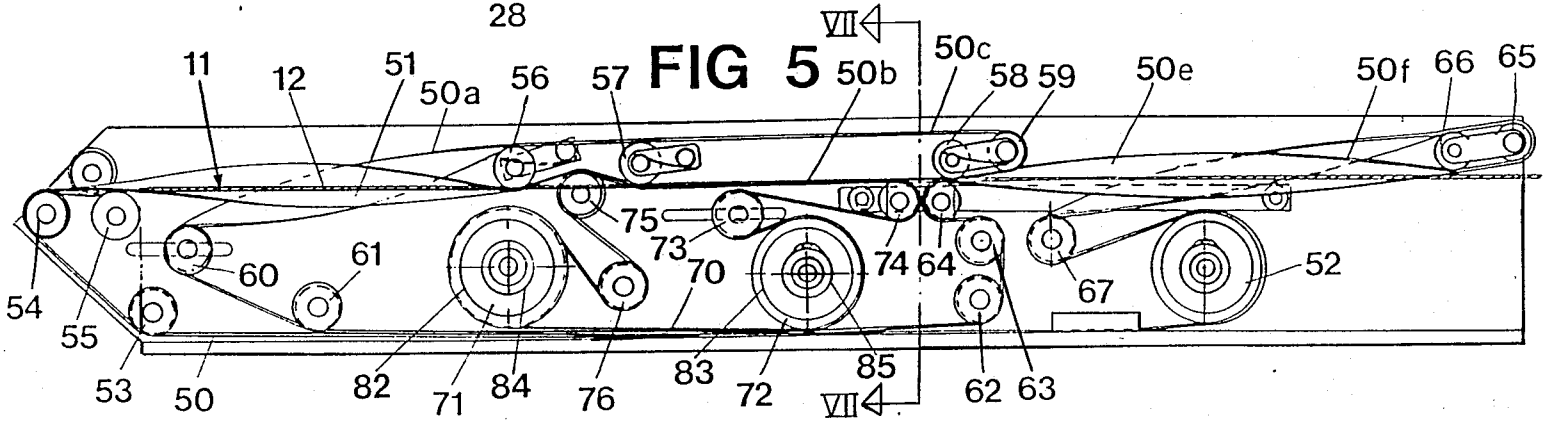
FIG. 5 is a side view of a device in accordance with another preferred embodiment of the invention.

The device illustrated in FIG. 5 differs from the previous embodiment by the fact that the shaping means comprises one single endless, driven band 50 cooperating with a shaping rule 51. The rule 51 is fixed to the table 11. The band 50 is driven by a drive roll 52. The band 50 extends from the drive roll 52 around pulley rolls 53, 54, and 55, until the band 50 is located on a level with the top 12 of the feed table 11. Between the roll 55 and a roll 56, the band 50 is twisted through 180° so that a portion 50a of the band 50, during a substantial part of its length, is in contact with the correspondingly shaped rule 51. The roll 56 is spring-loaded so that it presses against the table top 12. From the roll 56, the band 50 continues with a straight portion 50b via a further spring loaded roll 57 to a roll pair 58, 59. The first roll 58 is pivotable about a spring biased axle of the second roll 59. From there, the band 50 turns 360° back along a straight portion 50c parallel to the portion 50b until the band 50 comes to the roll 56. From there, the band 50 twists through 180° until it comes to a roll 60 beneath the roll 54. The portion 50b follows the twisting of the portion 50a. The band 50 continues from the roll 60 to pulley rolls 61, 62, 63, and 64 and then, as a band part 50e, twists through 180° toward a second roll pair 65, 66. The roll pair 65, 66 are similar to the roll pair 58, 59 inasmuch as the roll 65 is stationary and the roll 66 is pivotable and spring-biased with respect to the roll 65. The roll 66 presses the part 50e against the top 12 of the table 11. The band 50 continues, 50f, from the roll pair 65, 66, twisting through 180° to the pulley roll 67, and then back to the drive roll 52.

A second endless band 70 extends around two drive rolls 71 and 72 and is parallel to the portion 50b between two pulley rolls 73 and 74. The band 70 separates from the band 50 as the band 70 travels around a pulley roll 75 arranged between the spring-loaded rolls 56 and 57, and travels around a pulley roll 76 and then back to the drive roll 71.

Figure 7:
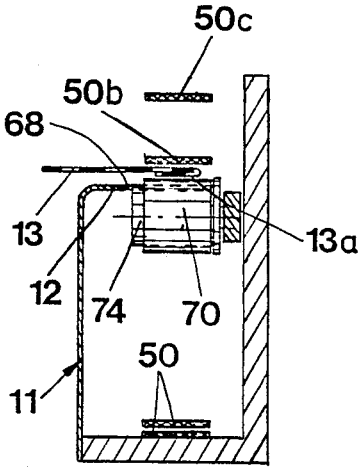
FIG. 7 is a cross-sectional view through the line VII—VII of FIG. 5.

The device illustrated in FIG. 5 functions as follows: Fabric 13 (FIG. 7), e.g., a sheet, which, by appropriate transport means such as endless transport bands (not illustrated) is transported along the table 11 with the edge 13a of the fabric 13 to be hemmed contacting the side of the table 11. The fabric edge 13a is inserted under the roll 66 and is then transported by the endless band 50 in cooperation with the table top 12 and the rule 51. The fabric 13 is pressed by the band portion 50e against the table top 12, while a projecting portion of the fabric 13 hangs down freely along the side of the table top 12. During continued displacement along the feed table 11, the projecting edge 13a will be turned by the 180° twisted band 50 against the underside of the table top 12. A recess is located in the top of the table 11 opposite the roll 64 underneath the top 12 of the table 11 to separate from the top 12 as illustrated in FIG. 7. Continued displacement of the fabric 13 through the device is then controlled by the band part 50b. The band 70 and the band part 50b transport the folded fabric edge 13a along the shaping rule 51. The edge 13a is then transported by the band part 50a along the shaping rule 51. Since the band part 50a between the roll 56 and the roll 54 is twisted 180° in the same way as the shaping rule 51, the once folded fabric edge 13a will be further folded, so that a double folded hem is formed.

The drive wheels 71 and 72 drive the second band 70. Built-in couplings are provided for switching these drive wheels 71 and 72 from a driving position to an off position. The drive wheels 71 and 72 cooperate with drive means which operate at different speeds. As a result, the speed of the band 70 will be changed depending on which of the drive wheels 71 and 72 is driven. One of the drive wheels, e.g., 71, is driven at a speed corresponding to the speed at which the band 50 is normally driven. The other drive wheel, e.g., 72, is driven at a somewhat higher speed. By temporarily operating the wheel 72 as the drive wheel for the band 70 and disconnecting the wheel 71 as the trailing end of the hem passes through the folding device, the folded part 13a will be drawn somewhat in front of the rest of the fabric 13, so that the trailing edge of the hem will be located somewhat inside the transverse edge of the fabric 13. A change in the speed of the band 70 can also be achieved by operating the drive wheel 71 at different driving speeds.

Figure 6:
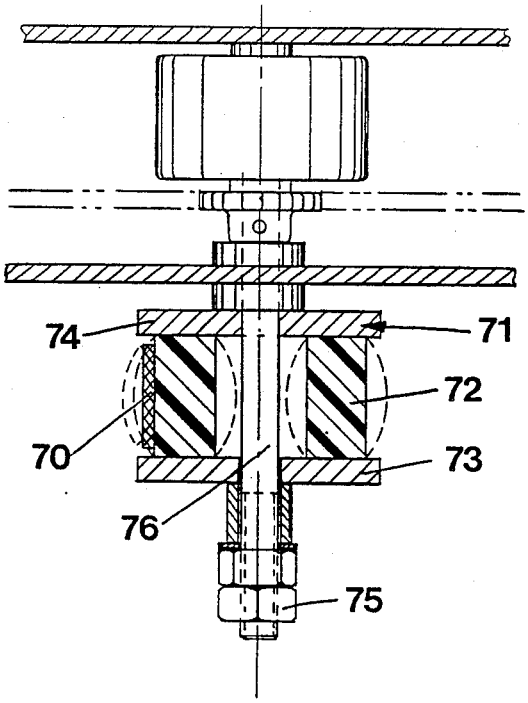
FIG. 6 is an enlarged cross-sectional view of a band stretching device in accordance with the invention.

The relative speeds of the bands 50 and 70 can be adjusted by the device illustrated in FIG. 6, which corresponds to the wheel 71 illustrated in FIG. 5. The wheel 71 includes a rubber cylinder 77 clamped between two plates 78 and 79. A nut 80 is provided for tightening the plate 78 along the wheel axle 81 to axially compress the rubber cylinder 77. This causes the cylinder 77 to expand, as illustrated with dashed lines in FIG. 6. As the cylinder 77 expands, the band 70 is stretched, causing the speed of the band 70 to increase. In other words, the device illustrated in FIG. 6 includes means for temporarily varying the speed of the cooperating endless band 70. This means includes the wheel or driving roll 71 which drives the band 70. The driving roll 71 has an adjustable diameter 77, whereby the band 70 can be stretched to adjust its speed relative to the band 50. This device is primarily intended for manual synchronization of the speeds of the bands 50 and 70.

The invention is not limited to the embodiments described and illustrated. Variations are possible within the scope of the claims.

I claim:

1. A device for folding a first edge of a fabric to form a hem, said device comprising:

(A) a table, said table having a top, said top having a side;

(B) feeding means for feeding the fabric along said top of said table with the first edge of the fabric hanging over said side;

(C) folding means, comprising:

(1) a fixed rule; and (2) a pair of cooperating endless bands for cooperating with said fixed rule to form the hem by gradually folding the first edge of the fabric as the fabric is fed along said top of said table, one of said cooperating endless bands having a twist which corresponds to the gradual folding of the first edge of the fabric; and (D) means for temporarily varying the speed of one of said cooperating endless bands relative to the other of said cooperating endless bands so that an end of the hem is located even with or within a second edge of the fabric.

2. The device of claim 1, wherein said device is adapted to form a single hem.

3. The device of claim 1, wherein said device is adapted to form a double hem.

4. The device of claim 1, wherein said top of said table is substantially horizontal.

5. The device of claim 1, wherein said means for temporarily varying the speed of one of said cooperating endless bands comprises:

a stretching device for stretching one of said bands; and an actuator for actuating said stretching device.

6. The device of claim 1, wherein said means for temporarily varying the speed of one of said cooperating endless bands comprises a roll for driving one of said bands, said roll being rotatable at different speeds.

7. The device of claim 1, wherein said means for temporarily varying the speed of one of said cooperating endless bands comprises two drive wheels which are drivable at different speeds.

8. The device of claim 1, wherein said means for temporarily varying the speed of one of said cooperating endless bands comprises a driving roll for driving one of said bands, said driving roll having an adjustable diameter, whereby one of said bands can be stretched to adjust the relative speeds of said bands.

9. The device of claim 8, wherein said driving roll comprises a resilient cylinder and means for axially compressing said cylinder.

* * * * *